US007390137B1

(12) United States Patent
Rentz

(10) Patent No.: US 7,390,137 B1
(45) Date of Patent: Jun. 24, 2008

(54) WRITING INSTRUMENT

(76) Inventor: Ceylon H. Rentz, 11894 Brady Rd., Jacksonville, FL (US) 32223-0759

( * ) Notice: Subject to any disclaimer, the term of this patent is extended or adjusted under 35 U.S.C. 154(b) by 0 days.

(21) Appl. No.: 11/622,155

(22) Filed: Jan. 11, 2007

(51) Int. Cl.
*B43K 24/02* (2006.01)
*B43K 27/00* (2006.01)
*A46B 5/02* (2006.01)

(52) U.S. Cl. ..... 401/112; 401/6; 401/30

(58) Field of Classification Search ..... 401/6, 401/29, 30, 109, 112, 113, 114; 200/547–550
See application file for complete search history.

(56) References Cited

U.S. PATENT DOCUMENTS 1,747,167 A * 2/1930 Hill ..... 15/443
2,883,968 A * 4/1959 Vertiz ..... 401/30
3,985,455 A * 10/1976 Wahlberg ..... 401/30
4,841,105 A * 6/1989 Goodman et al. ..... 200/16 D
5,051,552 A * 9/1991 Hou et al. ..... 200/549
6,290,413 B1 * 9/2001 Wang ..... 401/30
6,313,420 B1 * 11/2001 Ohashi ..... 200/302.1

* cited by examiner

*Primary Examiner*—David J Walczak
(74) *Attorney, Agent, or Firm*—Jonathan R. Smith P.C.

(57) ABSTRACT

A writing instrument comprising a smooth elongate case has a recessed switch for extending and retracting the tip of an ink cartridge. This allows the tip to be extended and retracted with one hand, while at the same time preventing the switch from being snagged by the contents or threads inside a pocket. A second embodiment provides two cartridges and a three-way switch, allowing one tip to be extended at one end of the instrument while the other end remains within the case. A third embodiment utilizes a single cartridge with two writing tips, one at either end.

2 Claims, 5 Drawing Sheets

WRITING INSTRUMENT

FIELD OF INVENTION

This invention is in the field of hand-held writing instruments, more specifically those designed for carrying in a pocket, and more specifically those designed for operation with one hand.

BACKGROUND OF INVENTION

The invention of the ballpoint pen in the $20^{th}$ century made carrying pens much more convenient. The ball was typically installed on one end of an ink "cartridge" or "refill" which could be removed from the pen for replacement. The main benefits were ease of refill of ink, cleanliness (reduced opportunity for ink spillage) and preservation of the ink supply (lower volatility of ink and less exposure of the ink to air). Part of the reduction in potential for ink spillage is the use of a ball, instead of a nib relying on capillary action, to apply the ink. Advances in ink technology increased the viscosity and lowered the volatility of the ink while at the same time reducing the time it takes the ink to set on the paper.

While ballpoint ink leaks far less easily than fountain pen ink, a ballpoint cannot be carried in clothing or accessories without risk of ink stains unless the point is covered by a removable and replaceable cap or contained within the pen (retractable). In some retractables, extension of the cartridge is effected by pressing a button on the end of the pen opposite the ball, with retraction accomplished by the press of a side button or pocket clip on the pen, or by pressing the end button again (the so-called "knock" pen). Other ballpoints extend and retract the ball by a twist of the pen.

Of all of these, only the cap pen and the twist pen dependably prevent inadvertent leak release into clothing or accessories. Their drawback, however, is that only an exceptionally dexterous person can open the pen with one hand. The knock pen and other push-button designs can be operated with one hand, but have the serious drawback of being subject to accidental extension of the ball in a pocket or handbag. Hence, a new pen is needed that may be operated with one hand but is not subject to accidental opening.

Also needed in conjunction with these needs is for the pen to be short in length so that it loosely fits in a pocket or accessory so that it may be easily retrieved.

BRIEF DESCRIPTION OF INVENTION

The first embodiment of the present invention is a writing instrument comprising a smooth elongate case and a recessed switch for extending and retracting the tip of an ink cartridge. This allows the tip to be extended and retracted with one hand, while at the same time preventing the switch from being snagged by the contents or threads inside a pocket.

The switch is not only recessed within the smooth outer surface of the case so that it will not be snagged by other objects, but it also has ridges molded into its outer surface which allow it to be moved back and forth along the writing instrument by frictional engagement with a finger. The switch also comprises a body underneath its outer surface (inside the case) to which a standard ink cartridge may be friction fit.

A second embodiment has a second cartridge within the case, disposed oppositely to the first, and having a tip which may be extended out the other end of the writing instrument. Alternatively, as a third embodiment, a single cartridge with writing tips at either end may be used. In the second and third embodiments, a three-way switch is provided that will extend one tip while the other is retracted or have a neutral position which extends neither tip.

OBJECTS OF INVENTION

The principal object of this invention is to provide a writing instrument that will not open inside an enclosure such as a pocket or accessory as a result of snagging upon or being pressed by other objects in the enclosure. A second object is for the writing instrument not to snag an enclosure by being too sharp. A third object is to provide these properties while not making the instrument more complex than existing pens, especially not requiring two hands to prepare to use (such as would be the case if it employed a cap or a twist-to-open mechanism).

DETAILED DESCRIPTION OF INVENTION

Figure 1:
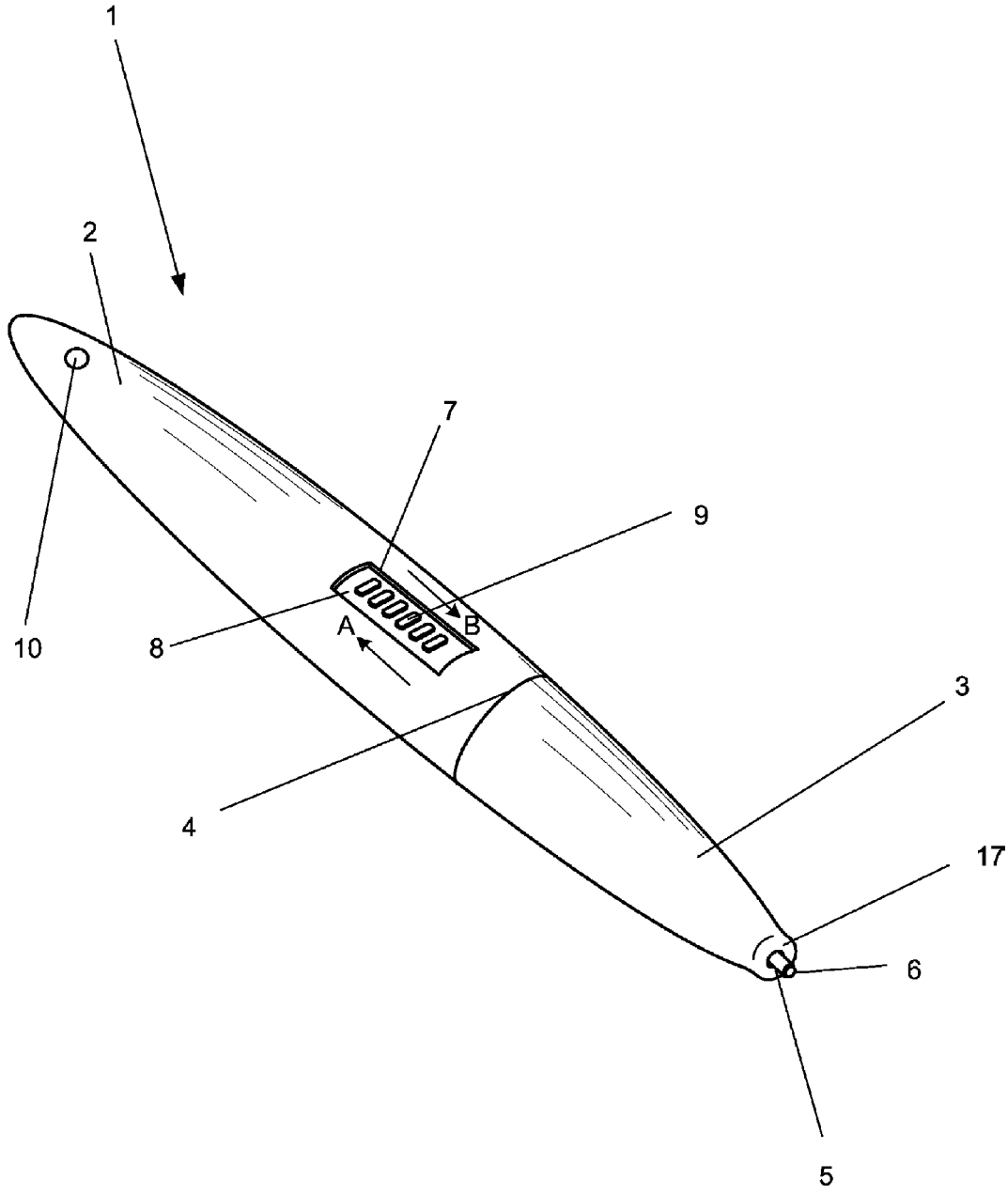
FIG. 1 is a perspective view of the first embodiment of the invention.

Referring now to the drawings, in which like elements in each drawing are represented by like reference numerals, FIG. 1 is a perspective view of the first embodiment of the invention. It is a writing instrument comprising an elongate, essentially elliptical hollow case 1 formed from a main shell 2 and a front shell 3, capable of being separated at joint 4 to permit insertion and removal of internal parts. Front shell 3 has a hole 5 in its vertex through which writing tip 6 extends. Note that front shell 3 has a flare 17 around hole 5; this blunts the end of front shell 3 so that it is less likely to snag within a pocket or purse and is less likely to punch a hole through either of those carrying receptacles. As shown here, flare 17 takes the form of a torus embedded in the end of front shell 3, the torus having an inside diameter equal to the diameter of hole 5 and lying in a plane perpendicular to the axis of case 1. In the preferred embodiment, the outside diameter of the torus forming flare 17 is approximately three times its inside diameter, and the thickness diameter of the torus is approximately equal to its inside diameter.

An elongate hole 7 is provided through the smooth outer surface of main shell 2, and an elongate switch 8 can be seen recessed within hole 7. A plurality of ridges 9 is formed into the surface of switch 8 to enable extension and retraction of tip 6.

By means more fully described below, tip 6 may be retracted or extended by fingertip pressure on ridges 9 inwardly and in directions A and B respectively.

An attachment hole 10 is optionally provided near the vertex of main shell 2 through which a cord or lanyard (not shown) may be secured to case 1 for better handling of the invention.

Figure 2:
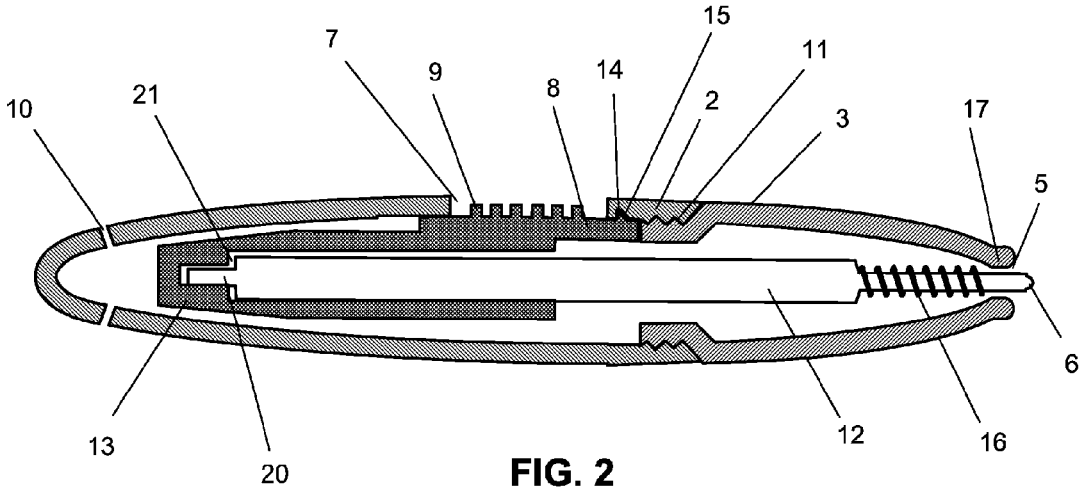
FIG. 2 is a side cross-sectional view of the first embodiment in the open position.

FIG. 2 is a side cross-sectional view of the first embodiment in the open position. It illustrates main shell 2 and front shell 3 joined together by screw threads 11. Other means of joining the two shells are included within the scope of the present invention. It can be seen that if the two shells are separated, an ink cartridge 12 may be placed within the case.

Internal parts of switch 8 can also be seen in this view. Switch body 13, molded with switch 8, is shaped to hold the back end of cartridge 12. The back end 20 of cartridge 12 is shown in FIG. 2 as friction-fitted releasably into shaped cavity 21 in switch body 13. An upward-facing tab 14 is molded into switch 8, shaped to fit within downward-facing detent 15 when tip 6 is in the extended position. A helical spring 16 is placed on tip 6 inside of hole 5 to bias tip 6 towards the closed position; in this figure, tip 6 is held in the extended position by tab 14 in detent 15.

Figure 3:
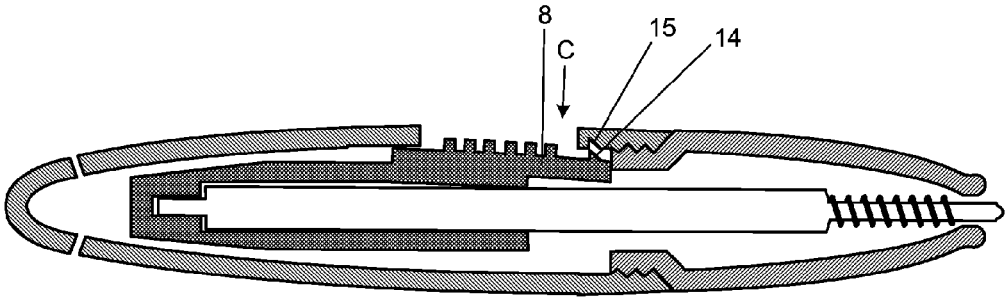
FIG. 3 is a side cross-sectional view of the first embodiment in the process of being closed.

FIG. 3 is a side cross-sectional view of the first embodiment in the process of being closed. If switch 8 is pushed downwardly in direction C by a fingertip, it can be seen that tab 14 is moved out of detent 15.

Figure 4:
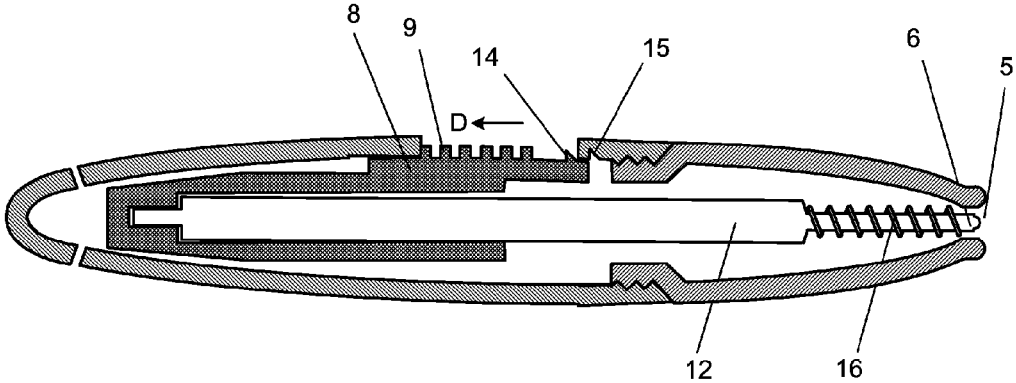
FIG. 4 is a side cross-sectional view of the first embodiment in the closed position.

FIG. 4 is a side cross-sectional view of the first embodiment in the closed position. If fingertip pressure is now used against ridges 9 to move switch 8 in direction D, that force, plus the biasing force of spring 16 will hold cartridge 12 to the left such that tip 6 is recessed within hole 5.

Figure 5:
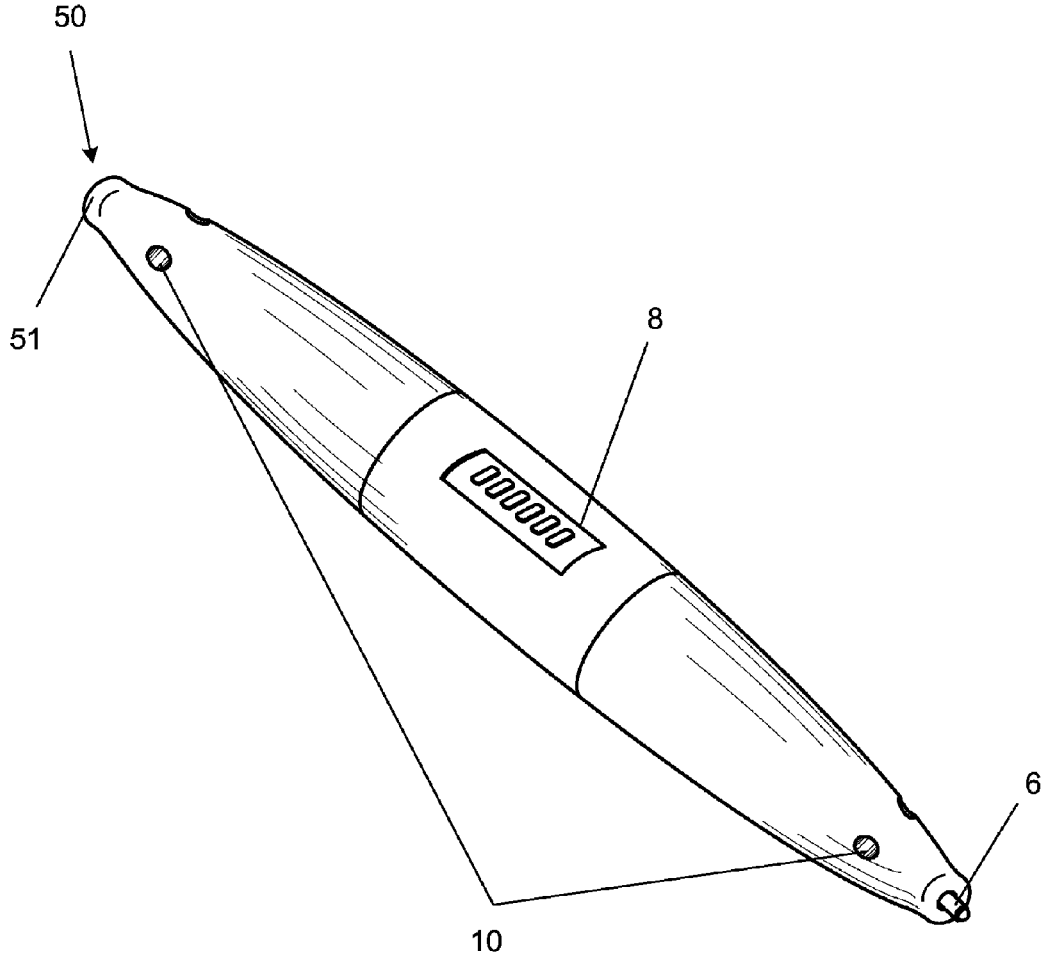
FIG. 5 is a perspective view of a second embodiment of the invention.

FIG. 5 is a perspective view of a second embodiment of the invention. The second embodiment has two writing tips, a first tip 6 at one end and a second tip 50 (hidden by second flare 51 in this view) at the other end of the writing instrument. Note here also that two sets of attachment holes 10 are provided at either end so that attachment can be made at either end depending on which writing tip is in ordinary use by the user at a given time.

Figure 6:
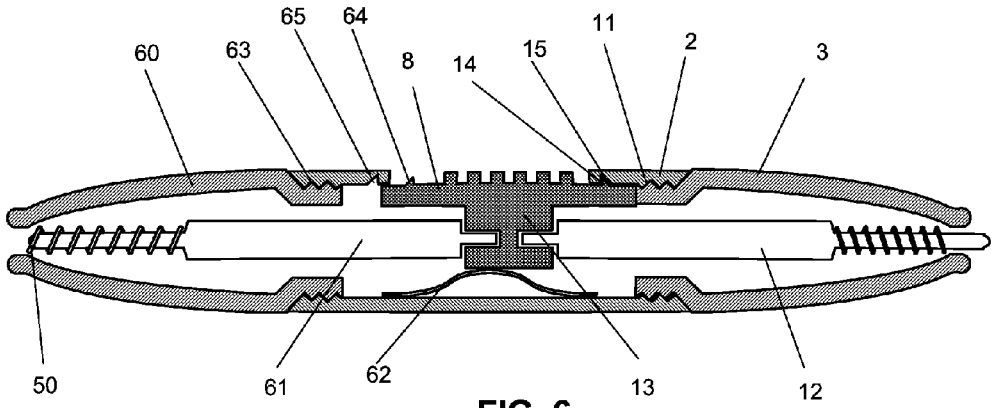
FIG. 6 is a side cross-sectional view of the second embodiment in a first open position.

FIG. 6 is a side cross-sectional view of the second embodiment in a first open position. It shows that in addition to front shell 3, a rear shell 60 is provided to house a second cartridge 61 and permit its insertion and removal. It attaches to main shell 2 with a second set of screw threads 63. Switch body 13 is shaped to grip two cartridges instead of one. In this first open position, tab 14 on switch 8 is engaged in detent 15 so that tip 6 extends from hole 5. Switch 8 is pressed upwardly by leaf spring 62 for positive engagement of tab 14 in detent 15. Note that a second upward-facing tab 64 and a second downward-facing detent 65 are provided. Because cartridge 12 is held to the right in this view, second cartridge 61 is also held to the right by switch body 13, and second tip 50 remains within rear shell 60.

Figure 7:
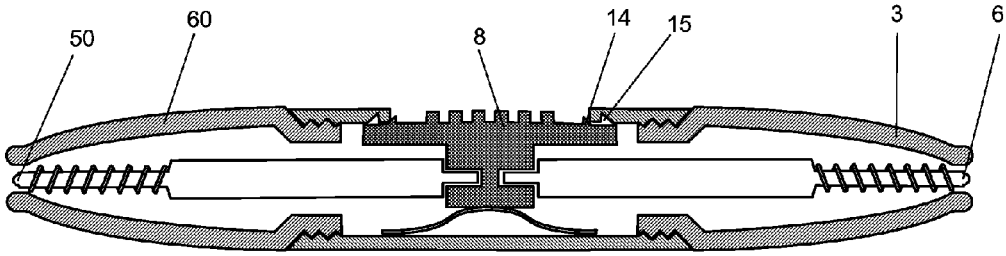
FIG. 7 is a side cross-sectional view of the second embodiment in the closed position.

FIG. 7 is a side cross-sectional view of the second embodiment in the closed position. Here, switch 8 has been pressed downward and to the left, releasing tab 14 from detent 15. Now, both tip 6 and second tip 50 are within their respective front shell 3 and rear shell 60.

Figure 8:
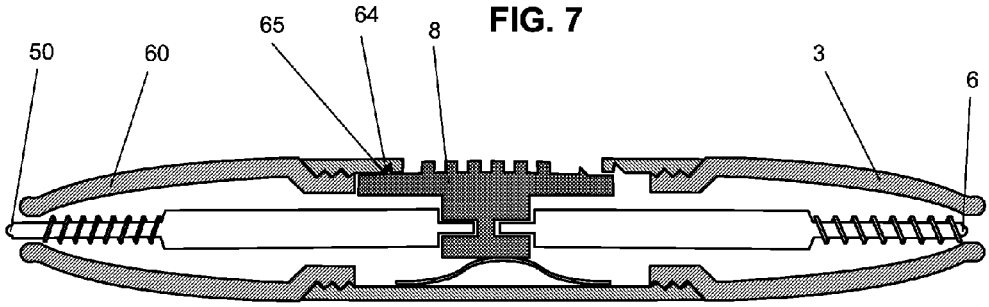
FIG. 8 is a side cross-sectional view of the second embodiment in a second open position.

FIG. 8 is a side cross-sectional view of the second embodiment in a second open position. Switch 8 has again be pressed downward and to the left, this time engaging second tab 64 in detent 65. Second tip 50 now protrudes from rear shell 60, in a position to be used for writing. Tip 6 remains within front shell 3.

Figure 9:
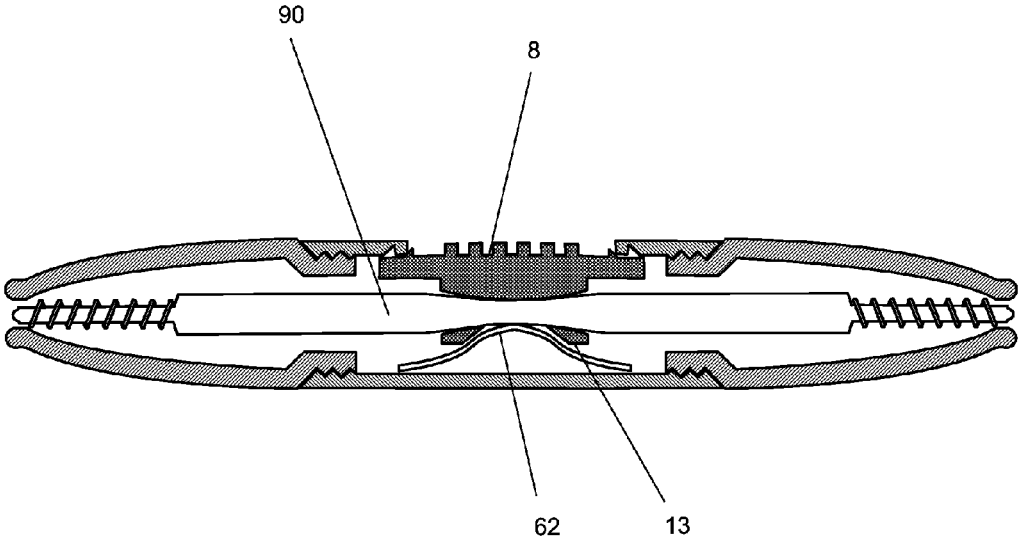
FIG. 9 is a side cross-sectional view of the third embodiment in a closed position.

FIG. 9 is a side cross-sectional view of the third embodiment in a closed position. Here, cartridge 12 and second cartridge 61 are combined into a two-ended cartridge 90. Cartridge 90 is held in place by switch body 13, aided by leaf spring 62. Here, switch body 13 is shaped so as to allow leaf spring to apply pressure directly against cartridge 90. This aids both in holding cartridge 90 so that it moves with switch 8, and also in squeezing cartridge 90 to pressurize the ink slightly for positive writing at either end.

What is claimed is:

1. A writing instrument, comprising:

a hollow case having an elongate axis, the case further comprising a first end;

a first hole in the first end;

a second end;

a smooth outer surface;

an inner surface;

a second hole in the one side of the case;

means for opening and re-closing the case;

a switch mounted on the inner surface of one side of the case which communicates through the second hole with the outer surface of the case; the switch further comprising means for releasably engaging a cartridge within the case;

means for operating the switch with one finger comprising a switch surface having a plurality of ridges arrayed substantially transversely to the elongate axis; and a cartridge within the case comprising a writing tip;

the cartridge being releasably affixed to the means for engaging the cartridge, so that when the switch is in a first position, the writing tip extends from the first hole, and when the switch is in a second position, the writing tip is within the case; and at least the first end is flared into the shape of a torus, the center of the torus congruent to the center of said first hole, the central plane of the torus being perpendicular to the axis of said case; and the inner diameter of the torus is approximately equal to the diameter of said first hole, the outer diameter of the torus is approximately equal to three times the diameter of the first hole, and the thickness diameter of the torus is approximately equal to the diameter of the first hole.

2. A writing instrument, comprising:

a hollow case having an elongate axis, the case further comprising a first end;

a first hole in the first end;

a second end;

a second hole in the second end;

a smooth outer surface;

an inner surface;

a third hole in one side of the case;

means for opening and re-closing the case;

a switch mounted on the inner surface of one side of the case which communicates through the third hole with the outer surface of the case;

the switch further comprising means for releasably engaging two cartridges within the case;

the switch further comprising means for operating the switch with one finger comprising a switch surface having a plurality of ridges arrayed substantially transversely to the elongate axis; and a first cartridge and a second cartridge within the case comprising a first tip and a second tip, respectively;

the cartridges being releasably affixed to the means for engaging the two cartridges, so that when the switch is in a first position, the first tip extends from the first hole and the second tip is within the case, and when the switch is in a second position, both tips are within the case, and when the switch is in a third position, the first tip is within the case and the second tip extends from the second hole;

both the first end and the second end are flared into the shape of a torus the center of each torus is congruent to the center of said first hole, and the central plane of each torus is perpendicular to the axis of the case; and the inner diameter of each of the tori is approximately equal to the diameter of the first hole, the outer diameter of each of the tori is approximately equal to three times the diameter of the first hole, and the thickness diameter of each of the tori is approximately equal to the diameter of the first hole.

* * * * *